US009498076B1

(12) United States Patent
Reid

(10) Patent No.: US 9,498,076 B1
(45) Date of Patent: Nov. 22, 2016

(54) ZIPPER PULL ASSIST TOOL

(71) Applicant: Sonya Reid, Bronx, NY (US)

(72) Inventor: Sonya Reid, Bronx, NY (US)

( * ) Notice: Subject to any disclaimer, the term of this patent is extended or adjusted under 35 U.S.C. 154(b) by 38 days.

(21) Appl. No.: 14/733,396

(22) Filed: Jun. 8, 2015

(51) Int. Cl.
*A44B 19/00* (2006.01)
*A44B 19/26* (2006.01)
*A47G 25/90* (2006.01)

(52) U.S. Cl.
CPC ..... *A47G 25/902* (2013.01); *A44B 19/262* (2013.01)

(58) Field of Classification Search
CPC ..... A47G 25/902
USPC ..... 294/3.6, 26; 24/40, 429, 430; D2/643; D11/221
See application file for complete search history.

(56) References Cited

U.S. PATENT DOCUMENTS 1,262,974 A * 4/1918 Pearen ..... F16G 11/10 24/598.5
2,496,176 A * 1/1950 Powers ..... F16K 27/02 251/214
2,939,193 A * 6/1960 Morgan ..... A47G 25/902 294/3.6
2,974,991 A * 3/1961 Gerrick ..... A47G 25/902 294/3.6
3,006,051 A * 10/1961 Maeder ..... A47G 25/902 294/3.6
3,355,779 A * 12/1967 Hurst ..... A47G 25/902 294/3.6
3,704,491 A 12/1972 Burgess
5,416,951 A * 5/1995 Keyaki ..... A44B 19/262 24/429
D362,830 S * 10/1995 Maggard ..... D11/221
5,603,542 A 2/1997 Walker
5,690,444 A 11/1997 Yuuki et al.
5,860,192 A * 1/1999 Chung ..... A44B 19/262 24/429
6,209,176 B1 4/2001 Anscher
6,415,482 B1 7/2002 Pontaoe
6,804,867 B2 10/2004 Oda et al.
8,205,306 B2 * 6/2012 Kovach ..... A44B 19/262 24/429
D694,152 S * 11/2013 Grettenberger ..... D11/221
8,677,574 B1 3/2014 Thiessen et al.
8,910,983 B1 * 12/2014 Neff ..... A47G 25/902 24/429
2007/0124901 A1 * 6/2007 Cyr ..... A44B 19/262 24/429
2010/0037438 A1 * 2/2010 Muratsubaki ..... A41F 1/008 24/429
2013/0007994 A1 1/2013 Iannello et al.

* cited by examiner

*Primary Examiner* — Paul T Chin
(74) *Attorney, Agent, or Firm* — Robert C. Montgomery; Montgomery Patent & Design LLC

(57) ABSTRACT

A clip to assist a user in pulling up a zipper is particularly suited for zippers located on the back of garments. The clip attaches to a zipper puller portion of a zipper and is provided with a spring-loaded clamping mechanism that grasps the puller. The clip is also provided with an extending elastic cord. The clip is installed upon the garment prior to donning and the cord is then grasped and pulled to close the zipper. A pair of release arms on the side of the clip is pressed together to install and release the clip from the zipper puller.

2 Claims, 3 Drawing Sheets

ZIPPER PULL ASSIST TOOL

RELATED APPLICATIONS

The present invention was first described in and claims the benefit of U.S. Provisional Application No. 62/055,194 filed Sep. 25, 2014, the entire disclosures of which are incorporated herein by reference.

FIELD OF THE INVENTION

The present invention relates generally to a clip to assist a user in pulling up a zipper.

BACKGROUND OF THE INVENTION

People with physical disabilities, such as the elderly, the handicapped, or those recovering from injuries or surgery know all too well of the difficulties that they encounter while performing tasks that most of us take for granted. What comes easily to those that are not physically challenged, such as climbing stairs, or bending down to tie one's shoes, requires extreme physical exertion, or worse yet, is altogether impossible to accomplish without assistance for those otherwise enabled. Among these difficulties, getting dressed is perhaps the most common.

In fact, there is perhaps no other article of clothing that poses more of a problem than a dress with the zipper in the rear. Even the most physically fit and agile among us have difficulty with dress zippers simply because of their awkward location. Accordingly, there is a need for a means by which the elderly, physically disabled, or virtually anyone can be provided with the ability to easily operate zippers on a dress. The use of the zipper pull assist tool allows dress zippers to be more easily operated by all regardless of agility in a manner which is quick, easy, and efficient.

SUMMARY OF THE INVENTION

The inventor has recognized the aforementioned inherent problems and lack in the art and observed that there is a need for a clip to assist a user in pulling up a zipper.

It is therefore an object of the invention to provide a zipper assist device, comprising a clamp assembly adapted for removable attachment to a zipper puller, an adapter attached to the clamp assembly and a tether attached or removably attached to an adapter aperture of the adapter. The clamp assembly further comprises a first release arm, having a first aperture at a proximal end thereof and a first jaw at a distal end thereof and a second release arm, having a second aperture at a proximal end thereof and a second jaw at a distal end thereof. The first and second jaws are capable of removable attachment to the zipper puller and the second release arm is hingedly attached to the first release arm to bias the first jaw and second jaw together.

The device further comprises a torsion spring; hingedly attaching the first release arm to the second release arm. The adapter is attached to the first and second apertures. The tether is made of elastic or fabric. The first and second jaw each comprises a plurality of teeth. The plurality of teeth is disposed along an inward-facing surface of each jaw. The plurality of teeth is integrally molded with each jaw. The adapter comprises a member having a cut-out consisting of one (1) of the following shapes: a circle, an oval and a rectangular.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
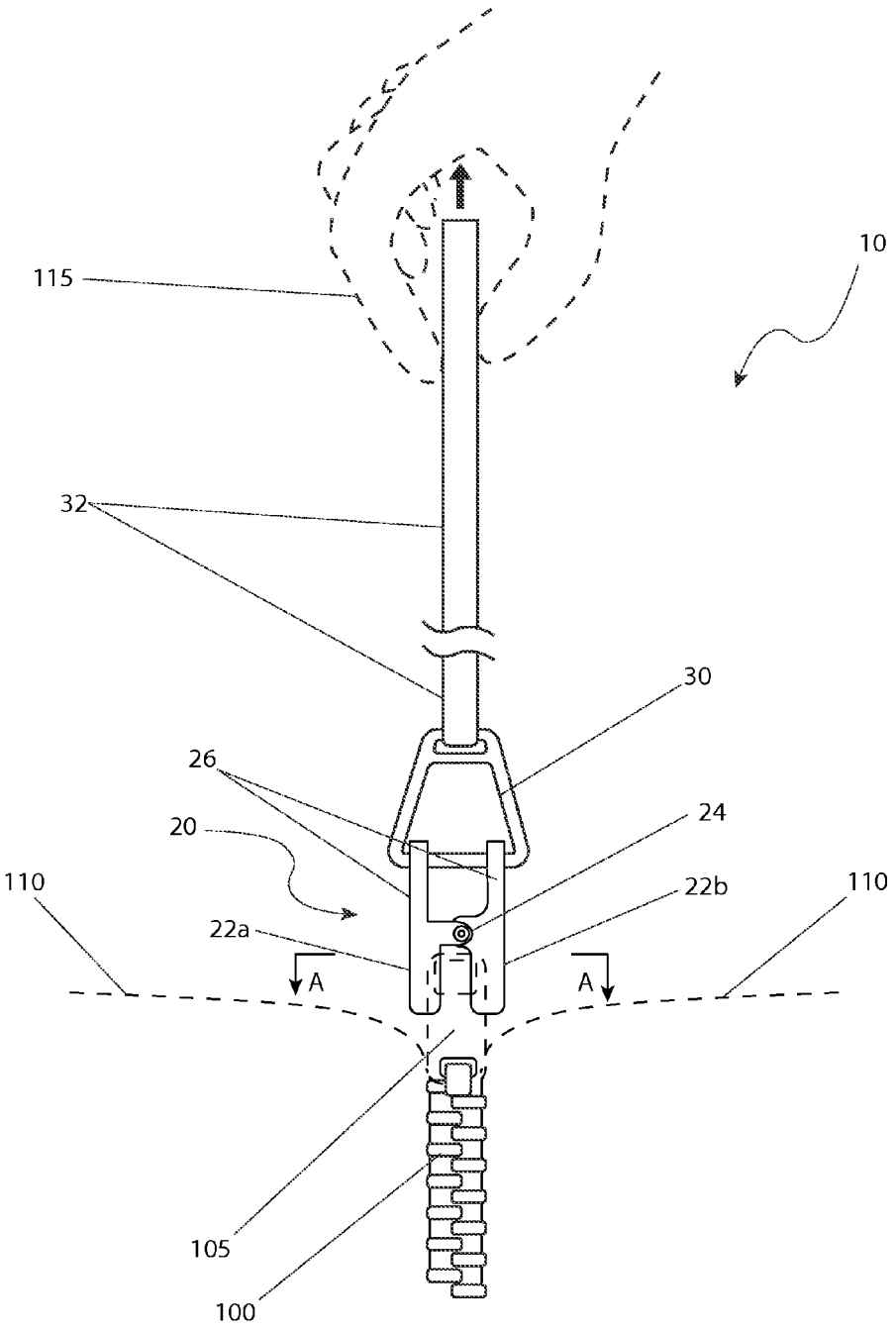
FIG. 1 is a rear view of a zipper pull assist device 10, according to a preferred embodiment of the present invention.

10 zipper pull assist device
20 clamp assembly
22*a* first jaw
22*b* second jaw
23*a* first tooth
23*b* second tooth
24 hinge
25 spring
26*a* first release arm
26*b* second release arm
27*a* first upper aperture
27*b* second upper aperture
30 adapter
32 tether strap
34 adapter aperture
100 zipper
105 puller
110 garment
115 user

DETAILED DESCRIPTION OF THE PREFERRED EMBODIMENT

Figure 2A:
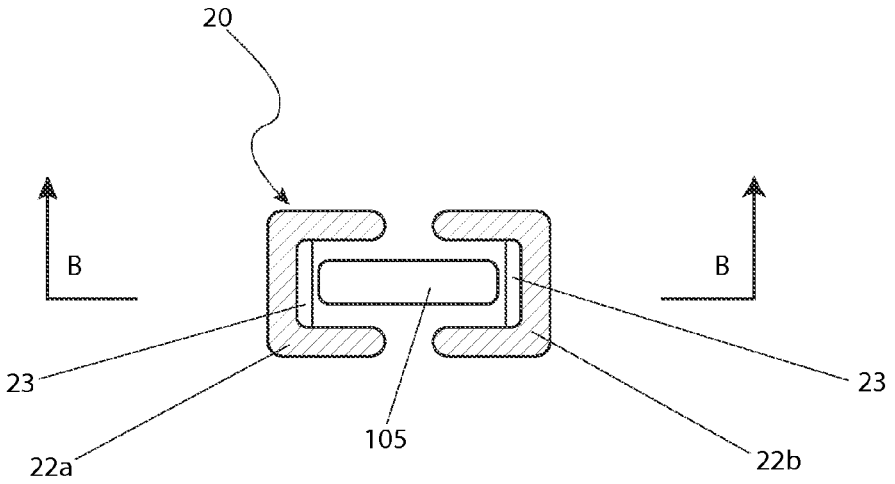
FIG. 2*a* is a top sectional view of the zipper pull assist device 10 taken along section line A-A (see FIG. 1), according to a preferred embodiment of the present invention; and, FIG. 2*b* is a sectional view of the zipper pull assist device 10 taken along section line B-B (see FIG. 2*a*), according to a preferred embodiment of the present invention.
Figure 2B:
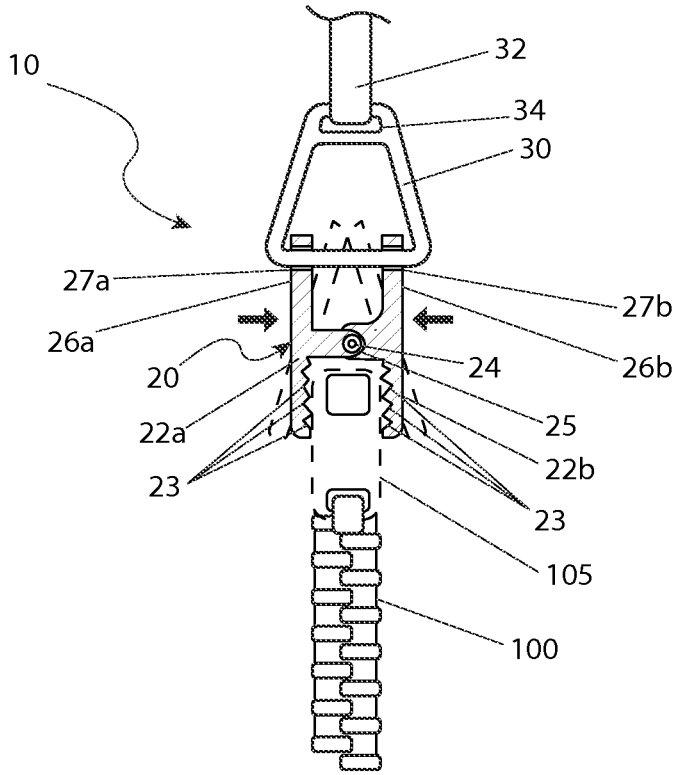

The best mode for carrying out the invention is presented in terms of its preferred embodiment, herein depicted within FIGS. 1 through 2*b*. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a zipper pull assist device (herein described as the "device") 10, which provides a means to assist a user 115 in pulling up a zipper 100 on a garment 110. The device 10 is envisioned to be especially useful when used to pull up a rear-positioned zipper 100 upon a dress or similar garment 110. Furthermore, the device 10 is envisioned to be useful when used by elderly, physically disabled or other persons who experience difficulty while reaching and operating a zipper 100.

Referring now to FIG. 1, a rear view of the device 10, according to the preferred embodiment of the present invention, is disclosed. The device 10 includes a plastic clamp assembly 20 that is removably attached to a zipper puller portion 105 of an existing zipper 100 located along a rear panel of a garment 110. The clamp assembly 20 includes features which also enable attachment of an elastic tether strap 32, via an adapter portion 30, to enable operation of the device 10 by the user 115. The device 10 is affixed to the zipper puller 105 prior to donning the garment 110, and then operated by the user 115 by reaching over their shoulder or around a waist area, and grasping and pulling upwardly upon the tether strap 32 to close the zipper 100. The clamp assembly 20 includes a pair of release arms 26*a*, 26*b* which may be pressed upon to release the device 10 from the zipper puller 105. The process may be reversed to allow the device 10 to also pull the zipper 100 down, if desired. The tether strap 32 is envisioned being made using a flexible rubber and/or fabric material, thereby applying a more consistent force to the clamp assembly 20 as tension is applied to close the zipper 100.

It is understood that the device 10 may be introduced for purchase in different sizes which correspond to different zipper pullers 105 having different widths, and may be sold separately or as a set.

Referring now to FIGS. 2*a* and 2*b*, top and rear sectional views of the device 10, according to the preferred embodiment of the present invention, are disclosed. The clamp assembly portion 20 of the device 10 includes a first jaw 22*a*, a second jaw 22*b*, a hinge 24, and a pair of release arms 26*a*, 26*b*. As seen in FIG. 2*b*, the clamp assembly 20 includes two (2) unitary and mirror-image half portions joined by the hinge 24, each half portion includes a bottom-positioned jaw 22*a*, 22*b* and an upper-positioned release arm 26*a*, 26*b*. Each jaw 22*a*, 22*b* includes a plurality of integrally-molded and pointed teeth 23*a*, 23*b* being arranged in an equally-spaced manner along an inward-facing surface. Each jaw 22*a*, 22*b* provides a channel-shaped cross-sectional form to surround and contain the puller 105 as seen in FIG. 2*a*.

The hinge 24 further includes a torsion-type spring 25 which acts to bias the jaws 22*a*, 22*b* toward each other, thereby securely clamping upon respective side edge portions of the puller 105. The jaws 22*a*, 22*b* may be opened and the puller 105 released by pressing the release arms 26*a*, 26*b* together. The hinge 24 pivotingly joins the jaws 22*a*, 22*b* and release arms 26*a*, 26*b* together to form an effective clamping device 20.

Each release arm 26*a*, 26*b* includes an upper aperture 27*a*, 27*b* located adjacent to an upper end portion, which provides inserting and rotating attachment of a plastic ring-shaped adapter 30 which provides a means to join the clamp assembly 20 and the tether strap 32 together. The adapter 30 is an open-center plastic member having a decorative shape such as circular, ovular, rectangular, or other like. The adapter 30 in turn includes an integrally-molded adapter aperture 34 along an upper edge portion which provides a means to attach the elastic tether strap 32.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of installing and utilizing the device 10 may be achieved by performing the following steps: procuring a model of the device 10 having particularly sized jaws 22*a*, 22*b* which clamp securely onto a correspondingly sized zipper puller portion 105 of the garment zipper 100; affixing the device 10 to the puller 105 prior to donning the garment 110 by pressing the release arms 26*a*, 26*b* together to separate the jaws 22*a*, 22*b*; inserting the zipper puller 105 between the jaws 22*a*, 22*b*; releasing the release arms 26*a*, 26*b*; allowing the teeth portions 23*a*, 23*b* of the jaws 22*a*, 22*b* to grip respective side edge portions of the puller 105; donning the garment 110 in a normal manner; reaching over the shoulder or along a waist area of the user 115 to grasp the tether strap portion 32 of the device 10; pulling upward upon the tether strap 32 until the zipper 100 is completely closed; reaching behind a user's neck area and pressing the release arms 26*a*, 26*b* together to free the tooth portions 23*a*, 23*b* of the jaws 22*a*, 22*b* from the puller 105; removing and storing the device 10 until needed again; and, benefiting from reduced effort and strain required while donning a garment 110 which has a zipper 100 located along a rear panel portion, afforded a user 115 of the present invention 10.

The device 10 may be utilized to pull the zipper 100 down on a previously donned garment 110 if desired by reaching behind a user's neck area and attaching the device 10 to the zipper puller 105 as previously described; pulling downwardly on the tether strap 32 to open the zipper 100; removing the garment 110 from one's bodice in a normal manner; and, pressing the release arms 26*a*, 26*b* together to remove the device 10 from the garment 110.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A zipper assist device, comprising:

a clamp assembly, further comprising:

a first release arm, having a first aperture at a proximal end thereof and a first jaw at a distal end thereof; and, a second release arm, having a second aperture at a proximal end thereof and a second jaw at a distal end thereof;

an adapter attached to said first and second apertures; and, a tether secured through an adapter aperture of said adapter;

wherein said first and second jaws are capable of removable attachment to a zipper puller;

wherein said second release arm is hingedly attached to said first release arm to bias said first jaw and second jaw together; and, wherein said clamp assembly provides a channel-shaped cross-sectional form to surround and contain said zipper puller.

2. A zipper pull assist device, comprising:

a clamp assembly, further comprising:

a first release arm, having a first aperture at a proximal end thereof and a first jaw at a distal end thereof; and, a second release arm, having a second aperture at a proximal end thereof and a second jaw at a distal end thereof;

an adapter attached to said first and second apertures; and, a tether removably secured through an adapter aperture of said adapter;

wherein said first and second jaws are capable of removable attachment to a zipper puller;

wherein said second release arm is hingedly attached to said first release arm to bias said first jaw and second jaw together; and, wherein said clamp assembly provides a channel-shaped cross-sectional form to surround and contain said zipper puller.

* * * * *